US009765552B2

(12) United States Patent
Beck et al.

(10) Patent No.: US 9,765,552 B2
(45) **Date of Patent: *Sep. 19, 2017**

(54) DOOR HANDLE ASSEMBLY FOR A MOTOR VEHICLE

(71) Applicant: Huf Huelsbeck & Fuerst GmbH & Co. KG, Velbert (DE)

(72) Inventors: Andreas Beck, Bochum (DE); Ralf Lennhoff, Hagen (DE); Mario Christensen, Mulheim (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 491 days.

This patent is subject to a terminal disclaimer.

(21) Appl. No.: 14/295,405

(22) Filed: Jun. 4, 2014

(65) Prior Publication Data

US 2014/0361556 A1 Dec. 11, 2014

(30) Foreign Application Priority Data

Jun. 5, 2013 (DE) ..... 10 2013 105 801

(51) Int. Cl.
*E05B 3/00* (2006.01)
*E05B 77/06* (2014.01)
(Continued)

(52) U.S. Cl.
CPC ..... *E05B 77/06* (2013.01); *E05B 85/10* (2013.01); *E05B 77/02* (2013.01); *Y10S 292/22* (2013.01); *Y10T 292/57* (2015.04)

(58) Field of Classification Search
CPC ..... Y10S 292/22; E05B 77/02; E05B 77/04; E05B 77/06; E05B 85/10; E05B 85/16
(Continued)

(56) References Cited

U.S. PATENT DOCUMENTS 6,648,382 B1 11/2003 Mönig et al.
7,481,468 B2 * 1/2009 Merideth ..... E05B 77/06 292/137
(Continued)

FOREIGN PATENT DOCUMENTS

DE 197 38 492 A1 3/1998
DE 19929022 1/2001
(Continued)

OTHER PUBLICATIONS

European Search Report of related European Application No. EP 14 17 0066 dated Jul. 31, 2015, 3 pages.

*Primary Examiner* — Carlos Lugo
(74) *Attorney, Agent, or Firm* — Fay Sharpe LLP

(57) ABSTRACT

A door handle assembly for a motor vehicle includes an operating handle moveably supported on a handle mounting, a mechanical coupling device and a locking device. An acceleration force can move the locking device from a normal operating position, in which an actuation of the operating handle is possible, in a first blocking direction, in which an actuation of the closing assembly via the operating handle and/or the coupling device, is blocked. The locking device also blocks the door handle assembly when long lasting or strongly pronounced oscillations occur as a result of a crash. In that event, the locking device can move from the normal operating position in a second blocking direction, in which an actuation of the closing assembly via the operating handle and/or the coupling device is blocked, wherein the second blocking direction is oriented opposite the first blocking direction.

13 Claims, 6 Drawing Sheets

(51) Int. Cl.
*E05B 85/10* (2014.01)
*E05B 1/00* (2006.01)
*E05B 77/02* (2014.01)

(58) Field of Classification Search
USPC ..... 292/336.3
See application file for complete search history.

(56) References Cited

U.S. PATENT DOCUMENTS

| | | | | |
|---|---|---|---|---|
| 8,152,209 | B2 * | 4/2012 | Lee | E05B 77/06 292/336.3 |
| 8,366,159 | B2 * | 2/2013 | Patel | E05B 77/06 292/203 |
| 8,840,156 | B2 * | 9/2014 | Savant | A47B 47/0008 292/336.3 |
| 8,857,866 | B2 * | 10/2014 | Savant | E05B 77/06 292/336.3 |
| 9,404,292 | B2 * | 8/2016 | Da Deppo | E05B 77/06 |
| 9,435,146 | B2 * | 9/2016 | Muller | E05B 77/06 |
| 2008/0136199 | A1 * | 6/2008 | Kim | E05B 77/06 292/340 |
| 2011/0120022 | A1 | 5/2011 | Papanikolaou et al. | |

FOREIGN PATENT DOCUMENTS

| | | | | |
|---|---|---|---|---|
| DE | 102009053553 | | 5/2011 | |
| EP | 2 138 656 | A2 | 12/2009 | |
| FR | EP 1605122 | A1 * | 12/2005 | E05B 77/06 |
| IT | EP 2942461 | A1 * | 11/2015 | E05B 77/06 |
| JP | WO 2014203930 | A1 * | 12/2014 | E05B 77/06 |

* cited by examiner

DOOR HANDLE ASSEMBLY FOR A MOTOR VEHICLE

BACKGROUND

The invention relates to a door handle assembly for a motor vehicle, having a frame-like handle mounting, an operating handle that is moveably supported on the handle mounting for opening a door or hatch of the motor vehicle by user, a mechanical coupling device, by means of which a movement of the operating handle can be transferred to a vehicle-side closing assembly, and a locking device serving as a mass locking device, which is moveably retained on the handle mounting and is designed such that, with the effect of an acceleration force, it can be moved from a normal operating position, in which an actuation of the operating handle is possible, in a first blocking direction, in which an actuation of the locking assembly by means of the operating handle and/or the coupling device is blocked.

Door handle assemblies of this type, having a locking device serving as a mass locking device, are intended to prevent the acceleration force occurring in an accident leading to an actuation of the operating handle, or door handle, respectively, and resulting in an unintentional opening of the door of the motor vehicle, which is accompanied by significant risks to a passenger in the motor vehicle. In typical door handle assemblies for motor vehicles, the handle components that are to be actuated by a user are mechanically coupled to a vehicle-side closing assembly (the actual door locking device). The movement of the door handle, or operating handle, respectively, is transferred to the closing assembly by the mechanical coupling device, and the door is allowed to open. In the case of an accident, the acceleration forces act, in unfavorable circumstances, in the manner of an actuation of the handle component by a user, because the handle can be accelerated in the opening direction due to inertia. With an operating handle, or door handle, respectively, without a corresponding locking device, the movement of the handle component in relation to the vehicle would lead to a transference of movement, by means of the coupling device, to the closing assembly in the vehicle, and to a releasing of the door. Example scenarios of such situations normally consist of a lateral collision with a barrier or another vehicle. A locking device serving as a mass locking device of this type, which may also be referred to as a crash lock, is known for door handle assemblies from the prior art.

By way of example, DE 199 29 022 C2 describes a mass locking device of this type in the form of a pivotal member, which is intended to block an actuation of the handle in the case of a crash. In the case of an accident, forces are exerted on a locking member, and an unintended movement of the handle, likewise caused by the forces acting thereon, is blocked.

A door handle assembly of the type indicated in the introduction is also known, for example, from DE 10 2009 053 553 A1. With this door handle assembly, an additional force acts on the operating handle, or door handle, respectively, by means of a crash lock, by means of which an unintended movement of the operating handle should be reliably prevented.

Crash locks of this type can be designed as a pendulum mass, such that, as a result of the force acting thereon, the crash lock is displaced, for example, into the movement path of the operating handle, thereby blocking the operating handle. Aside from this, crash locks are also known, which catch in a blocking position, and after their activation and catching, can only again be deactivated by means of a targeted intervention in the door handle unit, such that the door handle can again be used in the normal operation.

With door handle assemblies known from the prior art, having a mass locking device, or a locking device, respectively, that does not lock in place when activated, but rather returns, or swings, respectively, to its normal operating position, there is the disadvantage that, with the effects of acceleration forces, the locking device can move, or swing, back and forth, such that the locking device can become located in a position during its swinging, in which the pivot arm, or the operating handle, respectively, is not blocked, despite the crash. This is because the known locking devices are only active in a relatively small operating displacement range that blocks an actuation of the pivot arm, or operating handle, respectively, such that, either with strong and pronounced oscillations, or with oscillations occurring over a long period of time as a result of the effects of acceleration forces, there is the danger that, with locking devices swinging back and forth, the operating displacement range is not sufficient for reliably preventing a blocking of the operating handle, or pivot arm, respectively. For this reason, the locking device can assume a position in the case of a crash, during the swinging process, despite its activation, in which the operating handle, or the pivot arm, respectively, is not blocked.

BRIEF SUMMARY

The invention addresses the objective of creating a solution, which provides a door handle assemble in a simple and cost effective manner, with which the locking device reliably and securely blocks the operating handle, or pivot arm, respectively, even with oscillations resulting from a crash that occur over a long period of time, or are extremely pronounced.

With a door handle assembly of the type indicated in the introduction, the objective is attained according to the invention in that the locking device is designed such that it can move, as a result of the effects of an accelerating force, from the normal operating position in a second blocking direction, in which an actuation of the closing assembly by the operating handle and/or the coupling device is blocked, wherein the second blocking direction is opposite the first blocking direction.

Advantageous and useful designs and further developments of the invention can be derived from the dependent Claims.

A door handle assemble for a motor vehicle is provided by the invention, which is distinguished by a functional construction, and has a simple and cost-effective structure. Because the locking device is designed such that it can move, as the result of the effects of an acceleration force, from the normal operating position, not only in a first blocking direction, but also in a second blocking direction, the field of application for the locking device is increased, because this can now no longer only be activated by an acceleration force acting in a single, predetermined direction, but also by the effects of an acceleration force in a second direction. This property of the locking device is advantageous, in crashes, for example, in which, due to the acceleration forces acting thereon, pronounced oscillation processes prevail, leading to a back and forth swinging of the locking device between a normal operating position and a blocking position. Due to the possibility, afforded according to the invention, that the locking device can also move in a second blocking direction in the case of a crash, the operating handle and/or the coupling device is also effectively blocked during a crash when the locking device swings back, because the locking device moves from a first blocking position, through the normal operating position, in a second blocking direction when it swings back, by means of which the locking device never remains, at any point in time, in the normal operating position, but rather, only passes through the normal operating position.

In order to ensure a secure and precise functionality of the door handle assembly, both in the case in which the locking device is disposed in its normal operating position, as well as in a movement of the locking device in the first or second blocking direction as the result of the effects of an acceleration force, it is advantageous in the structural design of the door handle assembly if the coupling device has at least one movement projection acting together with the locking device. The movement projection defines precisely the case in which a normal operation of the operating handle is possible, and when not.

In this regard, the invention further provides, in an advantageous design, that the locking device has a movement cavity, into which the movement projection of the coupling device can at least be moved for actuating the operating handle when the locking device is disposed in the normal operating position. This does not exclude the possibility that the movement projection of the coupling device cannot also move completely through the movement cavity.

In order to design the installation space of the door handle assembly such that it is as small as possible, it is provided in the design of the invention that the locking device is designed, at least in sections, as a hollow cylinder, wherein the movement cavity is formed such that it runs, starting at the open front end of the hollow cylinder, in the longitudinal direction thereof.

Regarding the desired and precisely predefined interaction of the coupling device and the locking device, there is a structurally simple and cost-effective possibility for the further development thereof, in that the locking device is designed such that, when the operating handle is not actuated, the movement projection extends into the open front end of the hollow cylinder in the normal operating position, and when the operating handle is actuated, the actuation projection moves through the movement cavity and out of the hollow cylinder, away from the locking device.

Alternatively to the design above, the locking device can, for reasons of a minimal installation space, be designed, at least in sections, as a disk element, on one lateral surface of which, the movement cavity in the locking device is designed as a guide channel, open on one side, which extends, offset to the center of the disk element, on this lateral surface.

The interaction of the coupling device and the locking device is provided for in the above design in a further development of the invention, in that, in the normal operating position of the locking device, the movement projection is disposed outside the guide channel when the operating handle is not actuated, and when the operating handle is actuated, the actuating projection is designed to move into the guide channel.

Likewise practical, with regard to a minimal installation space that is to be expected, is that when, in a further design of the invention, the locking device is rotatably supported on the handle mounting by means of a pivot axle, and when the movement of the locking device in the first or second blocking direction is a rotational movement of the locking device.

The minimal installation space is further benefitted as a result, in that, in another design of the invention, it is provided that the pivot axle of the locking device is rotatably supported at its center. As a result, in comparison with crash locks, or locking devices, respectively, from the prior art, which extend and are deflected pivotally in the manner of a lever, less installation space is required, because the rotational movement requires no additional movement space when the locking device is activated, i.e. when the locking device is moved in the first or second blocking direction.

In order to implement a blocking of the operating handle with acceleration forces acting thereon, which are directed in the direction of the interior of the vehicle, or in the opposite direction, the invention provides, in a further design, that the locking device can rotate about the pivot axle at least ±90°, preferably ±285° from the normal operating position, due to the effects of an acceleration force. This rotational path, or swinging path, respectively, with the activation of the locking device, is sufficiently large enough that the crash state, which occurs as a result of the effects of the acceleration forces in conjunction with the oscillations to the vehicle structure generated thereby, comes to an end, before the locking device is again returned to where it rests in the normal operating position because of its spring tension.

In a further design, the invention provides that the locking device has a mass weight, which is disposed such that it is offset to the pivot axle on the locking device. The acceleration forces interact with this mass weight, and ensure that the locking device, when activated, rotates about the pivot axle in the first or second blocking direction.

The invention provides, in an advantageous design, that the coupling device is rotatably supported about a point of rotation on the handle mounting, wherein the pivot axle of the locking device is oriented such that it is substantially transverse to the point of rotation of the coupling device.

Alternatively to the preceding orientation of the coupling device and locking device, the invention provides, in one design, that the coupling device is rotatably supported about a point of rotation on the handle mounting, wherein the pivot axle of the locking device is oriented such that it is substantially parallel to the point of rotation of the coupling device.

In order that the operating handle is no longer blocked after the effects of acceleration forces, it is advantageous in one design of the invention if a mechanical return element is provided, which exerts a force that forces the locking device into the normal operating position. In differing from known locking devices, which, in the case of a crash, lock in place as a result of the effects of acceleration forces, and must first be manually released in order that the operating handle can be actuated, the operating handle can thus be used and actuated again after the effects of acceleration forces, because the locking device is again located in the normal operating position.

In one design of the invention, it is then provided that the mechanical return element comprises an elastic spring element, which is supported against both a projection that is fixed in place on the handle mounting, as well as against a contact surface that moves together with the locking element, wherein the contact surface moves in relation to the projection, against the force of the elastic spring element, when the locking device moves in the first or second blocking direction.

Lastly, the invention provides, in one design, that the mechanical return element is configured such that it retains the locking device in the normal operating position, until an acceleration force has reached at least 7 g. The locking device is only activated by a greater acceleration force, and rotates in the direction of the first or second blocking direction, and oscillates in these two directions, without remaining thereby in the normal operating position, such that an actuation of the operating handle is effectively blocked. This threshold value is sufficient for preventing an unintended activation of the locking device, and thus its deflection.

It is to be understood that the features specified above, and those still to be explained below, can be used not only in the respective given combinations, but also in other combinations, or in and of themselves, without abandoning the scope of the present invention. The scope of the invention is defined only by the Claims.

BRIEF DESCRIPTION OF THE DRAWINGS

Further details, features and advantages of the subject matter of the invention can be derived from the following description in conjunction with the drawings, in which exemplary, preferred embodiment examples of the invention are depicted. Shown in the drawings are.

DETAILED DESCRIPTION

Figure 1:
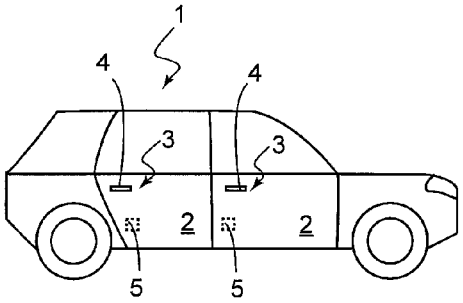
FIG. 1: a side view of a motor vehicle having numerous door handle assemblies according to the invention.

In FIG. 1, a vehicle, or motor vehicle 1, respectively, in the form of a passenger car, is shown by way of example, having four doors 2, which can be opened by means of a door handle assembly 3, and in particular, using a door handle, or operating handle 4, respectively. The doors 2 are firmly closed by means of respective closing assemblies 5, and can only be opened from the outside by means of a respective movement of the operating handle 4. This movement of the operating handle 4 can consist of a pulling and/or lifting movement, wherein the corresponding movement of the operating handle 4 is mechanically transferred to the corresponding closing assembly 5 via at least one coupling device. The corresponding closing assembly 5, and thus the door 2 allocated thereto, can then be opened by means of the movement of the operating handle 4.

Figure 2:
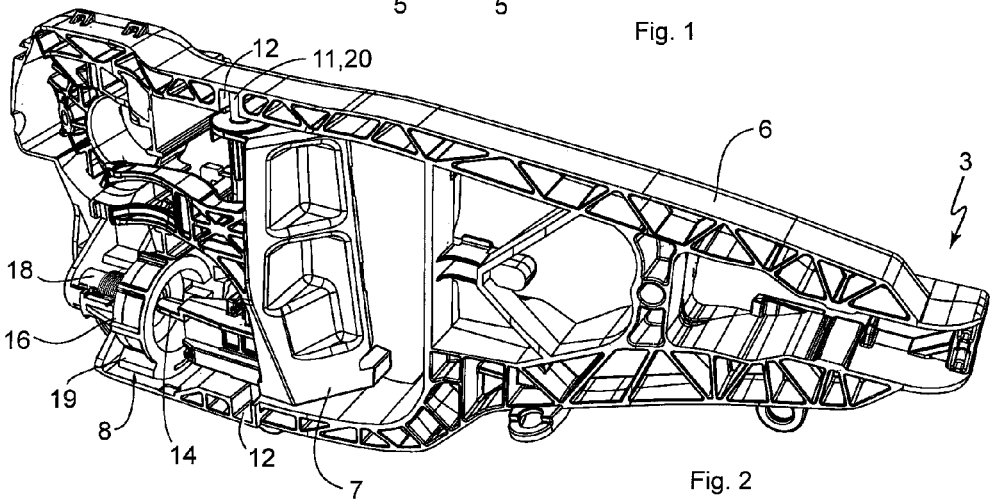
FIG. 2: a perspective view of a door handle assembly according to the invention, in accordance with a first embodiment of the invention.

In FIG. 2, the door handle assembly 3 according to a first embodiment is depicted in greater detail in a perspective view. The door handle assembly 3 has a frame-like handle mounting 6, wherein, for reasons of clarity in the FIGS. 2 and 6-9, which relate to a first embodiment of the door handle assembly 3, a depiction of the operating handle 4 is omitted. The handle mounting 6 serves, in the known manner, for the attachment of the operating handle 4, and is fastened to the door panel on the inside of the door by means of threaded fasteners that are not depicted, wherein the operating handle 4 is disposed on the outside of the door. For this, the handle mounting 6, for the purpose of saving on materials, is substantially formed by a frame structure, having various receiving spaces and mounting spaces, in order to be able to also receive, in addition to the operating handle 4, which is moveably and/or pivotally supported on the handle mounting 6 in order to open a corresponding door 2 of the motor vehicle 1 by a user, a mechanical coupling device 7, and a locking device 8, as well as, optionally, a locking cylinder that is not shown in detail in the figures.

A movement of the operating handle 4 can be transferred to the corresponding vehicle-side closing assembly 5 via the mechanical coupling device 7, in order to open the door 2. The locking device 8, serving as a mass locking device, can change in its position from a normal operating position to a blocking position through the effects of a force, such as an acceleration force, for example, wherein an actuation of the operating handle 4 is possible in the normal operating position, whereas, in the blocking position of the locking device 8, moveably retained on the handle mounting 6, an actuation of the closing assembly 5 by the operating handle 4 and/or a movement of the coupling device 7 by means of an actuation of the operating handle 4, is blocked. The locking device 8 can end up thereby in the blocking position by means of a movement in either a first blocking direction or in a second blocking direction. The second blocking direction is opposite the first blocking direction, as shall be explained below in detail.

Figure 4:
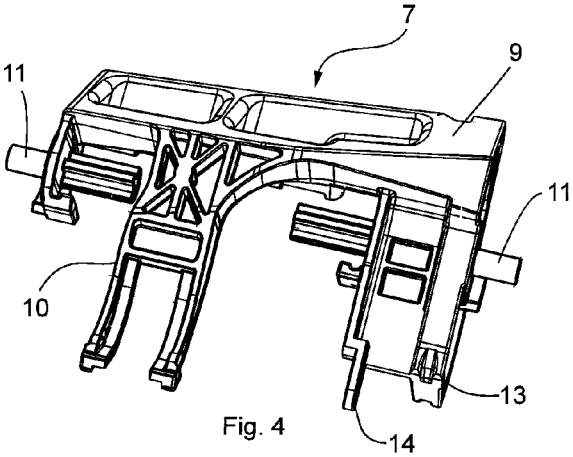
FIG. 4: a perspective view of a coupling device for the door handle assembly, in accordance with the first embodiment.

As can be seen in FIG. 2 and FIG. 4, which show the coupling device 7 in a perspective view, the coupling device 7 comprises a mass 9, a projecting pivot arm 10, and axle journals 11, by means of which the coupling device 7 is rotatably supported on the handle mounting 6. The handle mounting 6 has receiving fixtures 12 for the rotatable support of the axle journals 11. The mass 9 serves as a counterbalancing mass, to counteract against the weight of the operating handle 4 during an accident, or to counteract against the effects of an acceleration force. It should thus substantially compensate for the forces generated by the operating handle 4 and the coupling device 7, wherein the mass 9 is optional, and must not necessarily be provided. A movement of the operating handle 4 is transferred to the coupling device 7 by means of the pivot arm 10. The coupling device 7 is pivotally, or rotatably supported in a receiving space of the handle mounting 6 by means of the axle journals 11. The movement to the coupling device 7 introduced by the operating handle 4 is transferred therefrom to a transferring element, not shown, for the closing assembly 5 via a collar 13. In the present case, the collar 16 formed on the coupling device 7 is designed to accommodate a Bowden cable, which is retained in a form-locking manner at one end in a hole in the coupling device 7 provided for this purpose. For a reliable guidance of the Bowden cable, a guide groove is formed on the coupling device 7.

Figure 3:
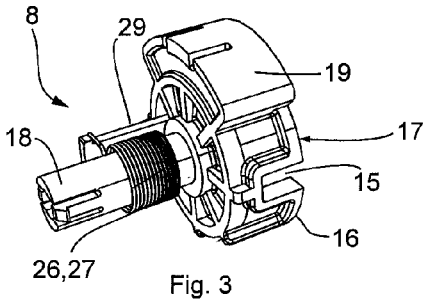
FIG. 3: a perspective view of a locking device for the door handle assembly, in accordance with the first embodiment.
Figure 5:
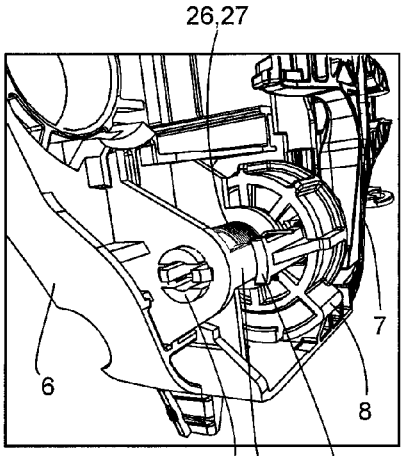
FIG. 5: a perspective view of a mechanical return element for the door handle assembly, in accordance with the first embodiment.

As can be derived from the FIGS. 3 and 4, by way of example, the mechanical coupling device 7 also has a movement projection 14, designed in the manner of a lever, which acts together with the locking device 8. A movement cavity 15 is formed on the locking device 8 itself, into which the movement projection 14 of the coupling device 7 can be inserted for an actuation of the operating handle 4 when the locking device 8 is disposed in the normal operating position.

In the first embodiment of the door handle assembly 3, the locking device 8 is designed in sections as a hollow cylinder 16, as is shown in FIGS. 2 and 6-9. The movement cavity 15 is formed in the shell of the hollow cylinder 16, running in the longitudinal direction, and represents a type of incision in the open front end 17 of the hollow cylinder 16 (see FIG. 3). In other words, the movement cavity 15 of the locking device 8, starting at the open front end 17 of the hollow cylinder 16, is formed running in the longitudinal direction thereof.

Figure 6:
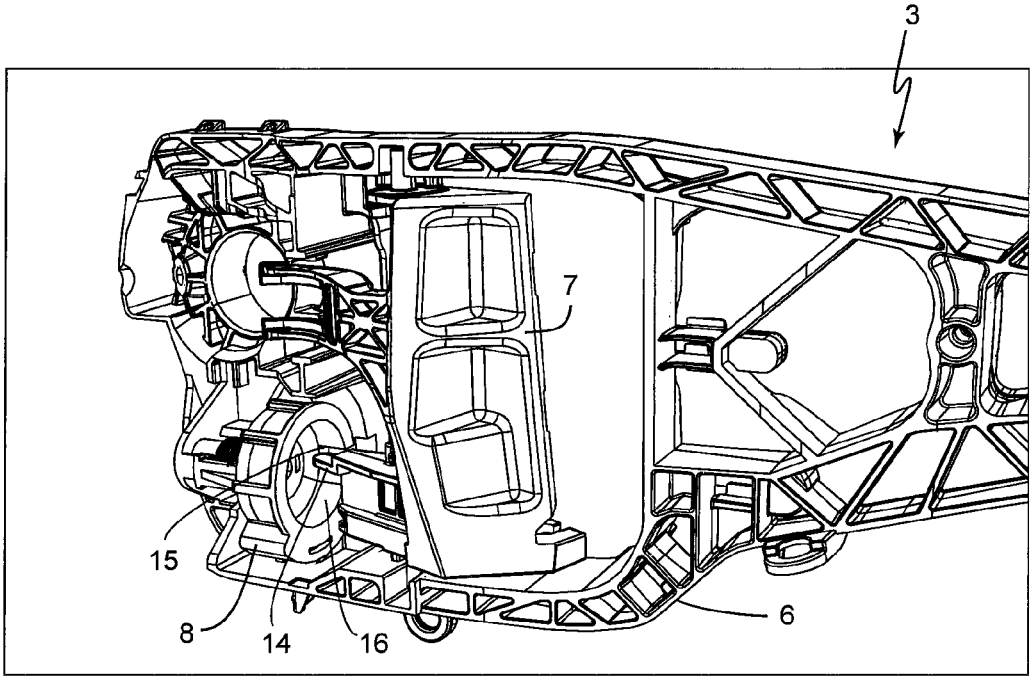
FIG. 6: a perspective view of the door handle assembly from FIG. 2, with the locking device in the normal operating position, and a partially actuated operating handle.
Figure 7:
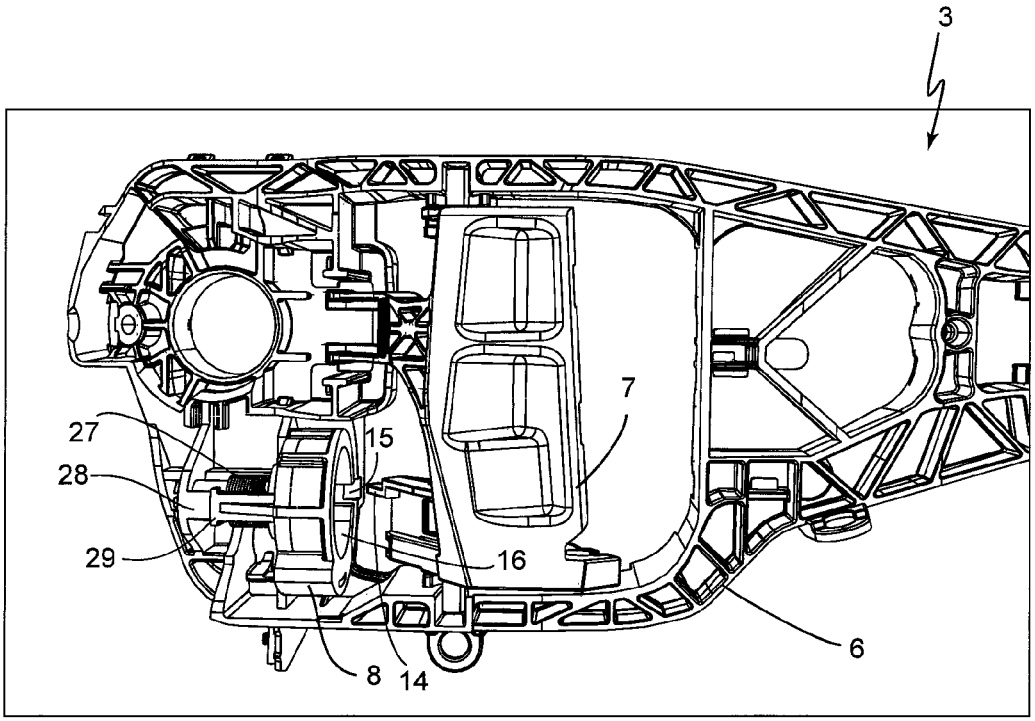
FIG. 7: a perspective view of the door handle assembly from FIG. 2, with the locking device in the normal operating position, and a fully deflected and actuated operating handle.

A state of the door handle assembly 3 is shown in FIG. 2, in which the locking device 8 is in its normal operating position and is thus not activated. Furthermore, in this state, the coupling device 7 is disposed in the rest position, because the operating handle is not actuated. In the normal operating position of the locking device 8, when the operating handle 4 is not actuated, the movement projection 14 extends into the open front end 17 of the hollow cylinder 16. In this state of the coupling device 7 and the locking device 8, the movement cavity 15 is disposed in the movement path of the movement projection 14, such that when the operating handle 4 is actuated, the movement projection 14 pivots the coupling device 7 coupled to the operating handle 4 about the Z axis of the door handle assembly 3, and is moved toward the movement cavity 15. This procedure is shown in FIG. 6, in which the operating handle 4 is actuated such that the movement projection 14 moves toward the movement cavity 15, and is disposed in part therein. With a further actuation of the operating handle 4 and the accompanying pivoting of the coupling device 7, the movement projection 14 moves through the movement cavity 15, and out of the hollow cylinder 16, and away from the locking device 8, as is shown in the depiction in FIG. 7. The operating handle 4 is completely actuated in this state, such that the coupling device 7 is also pivoted on the handle mounting 6 to the maximum extent, by means of which the movement projection 14 is moved such that it is moved through the movement cavity 15, and is now disposed outside of the hollow cylinder 16 of the locking device 8. After actuating the operating handle 4, i.e. when a user releases the operating handle 4, then this is pivoted back due to the tension of the spring in the coupling device 7, by means of which the movement projection 14 again extends into the open front end 17 of the hollow cylinder 16, or, respectively, is disposed in the interior of the hollow cylinder 16.

Figure 8:
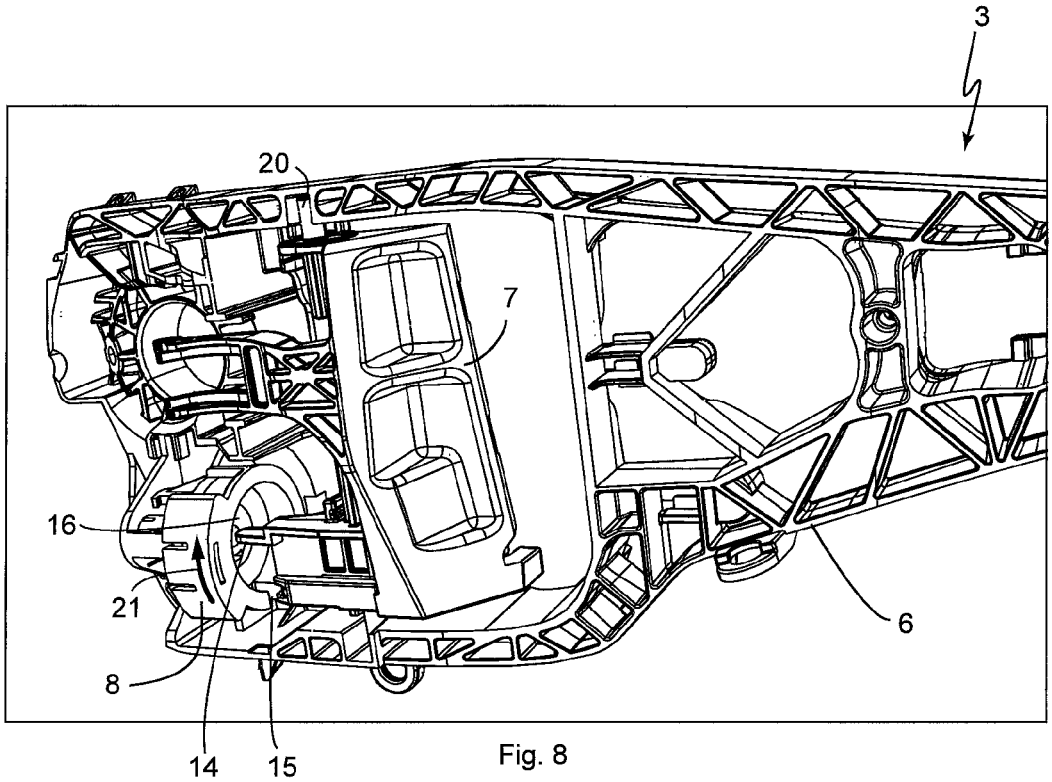
FIG. 8: a perspective view of the door handle assembly from FIG. 2, with the locking device after it has been moved in a first blocking direction.
Figure 9:
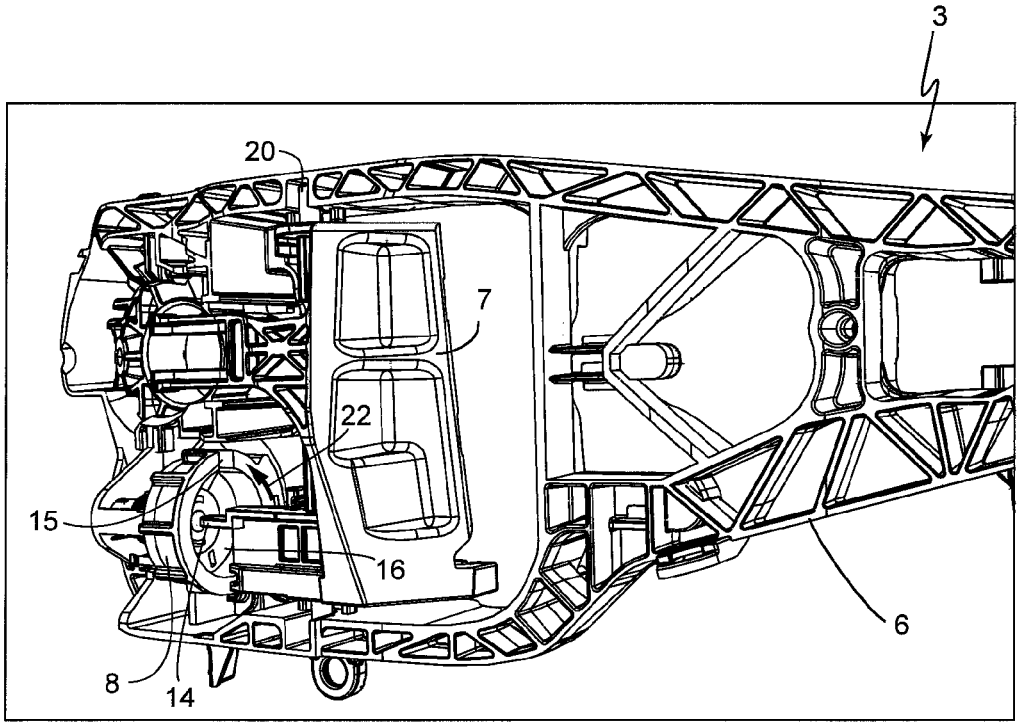
FIG. 9: a perspective view of the door handle assembly from FIG. 2, with the locking device after it has been moved in a second blocking direction.

FIGS. 8 and 9 show states of the door handle assembly 3 according to the first embodiment, in which there is an accelerating force to the door handle assembly 3 in the direction of the Y axis, and in particular, acting on the locking device 8. The locking device 8 is supported on the handle mounting 6 by means of a pivot axle 18, such that it can rotate about the X axis of the door handle assembly 3, and has a mass weight 19. The locking device 8 is supported thereby at its center by the pivot axle 18, such that it can rotate, wherein the mass weight 19 is disposed on the locking device 8, offset to the pivot axle 18. As a result of this configuration of the mass weight 19, the locking device 8 is moved out of its normal operating position as a result of the effects of an acceleration force in the direction of the Y axis (for example, as a result of a vehicle accident). The movement of the locking device 8 in the first or second blocking direction is a rotational movement about the pivot axle 18 as a result of the structural construction and the support of the locking device 8.

FIGS. 8 and 9 show exemplary states, in which the locking device 8 is first moved from the normal operating position in a first or second blocking direction, and is then in a respective blocking position, wherein the locking device 8 can move in both blocking directions during a vehicle accident as a result of oscillations. Then, the locking device 8 is first deflected in a first blocking direction as a result of the acceleration force acting thereon, and then rebounds, which is expressed by a movement of the locking device in the second blocking direction, which can also be referred to as a swinging movement in the first and second blocking directions. The locking device 8 passes through the normal operating position thereby, without remaining in this position. In FIG. 8, the locking device 8 is rotated −90° about the pivot axis 18 (Y axis) as a result of the effects of an acceleration force in the first blocking direction 21 (see arrow 21 in FIG. 8), such that the movement cavity 15 is then no longer in the movement path of the movement projection 14. In FIG. 9, in contrast, the locking device 8 is rotated +90° about the pivot axle 18 (Y axis) as a result of the effects of an acceleration force, or as a result of the swinging movement of the locking device 8 described above, in the second blocking direction 22 (see arrow 22 in FIG. 9), by means of which the movement cavity 15 now is no longer in the movement path of the movement projection 14. An actuation of the operating handle 4 or a pivoting of the coupling device 7, which is rotatably supported, about the point of rotation 20 for its axle journals 11, on the handle mounting 6, is blocked in FIGS. 8 and 9 as a result of the rotation of the locking device 8 about the pivot axle 18, because the movement projection 14 cannot move out of the interior of the hollow cylinder 16, but instead, hits the inner walls of the hollow cylinder 16 when deflected. The movement projection 14 is thus caught in the hollow cylinder 16 when the locking device 8 moves in the first or second blocking direction 21, 22, for which reason this can also be referred to as a catch cylinder, or locking socket 16. In the first embodiment of the door handle assembly 3, which FIGS. 1-9 are based on, the pivot axle 18 of the locking device 8 is oriented substantially transverse to the point of rotation 20 for the coupling device 7, in order to obtain the desired blocking of the operating handle 4, or the coupling device 7, when acted on by an acceleration force. Alternatively to the rotational angle of ±90°, about which the locking device 8 in FIGS. 8 and 9 is rotated, and can swing, from the normal operating position, as a result of the effects of an acceleration force, in the first or second blocking direction 21, 22, a smaller rotational angle or a larger rotational angle, of ±285°, for example, about the pivot axle 18, is also conceivable.

FIGS. 8-18 relate to a second embodiment of a door handle assembly 3' according to the invention. The second embodiment of the door handle assembly 3' also comprises a frame-like handle mounting 6 for attaching the operating handle 4, wherein, here too, for reasons of clarity, a depiction of the operating handle 4 is omitted. The handle mounting 6 of the second embodiment likewise supports, aside from the operating handle 4, a mechanical coupling device 7', by means of which a movement of the operating handle 4 can be transferred to the corresponding vehicle-side closing assembly 5 for opening the door 2, and a locking device 8', serving as a mass locking device, which can change its position, with the effects of an acceleration force, from the normal operating position, in which an actuation of the operating handle 4 is possible, to a blocking position, in which an actuation of the closing assembly 5 by means of the operating handle 4, and/or a movement of the coupling device 7' by means of an actuation of the operating handle 4, is blocked. The locking device 8' ends up in the blocking position here as well, by means of a movement in a first or second blocking direction.

Figure 10:
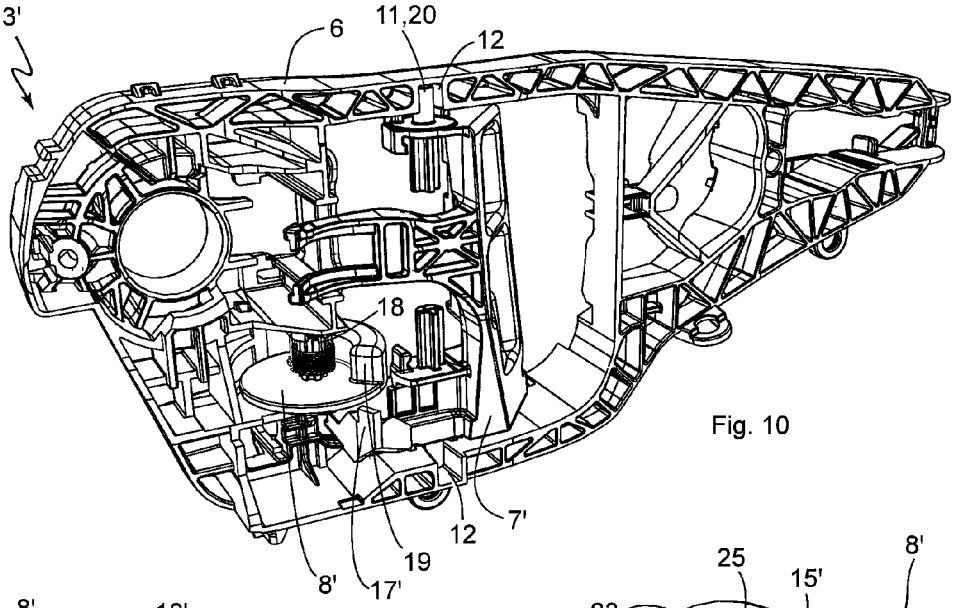
FIG. 10: a perspective view of a door handle assembly in accordance with a second embodiment of the invention.
Figure 12:
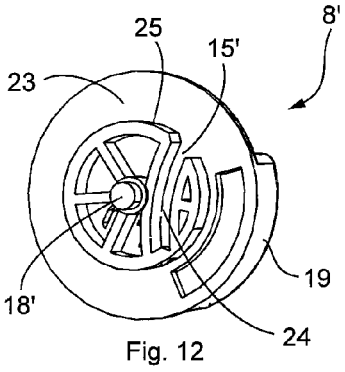
FIG. 12: the locking device from FIG. 11, seen from below.
Figure 13:
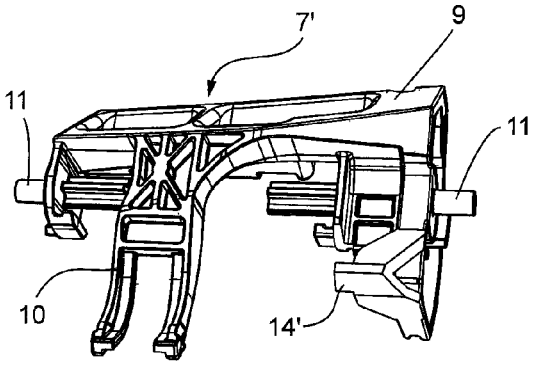
FIG. 13: a perspective view of a coupling device for the door handle assembly, in accordance with the second embodiment.
Figure 14:
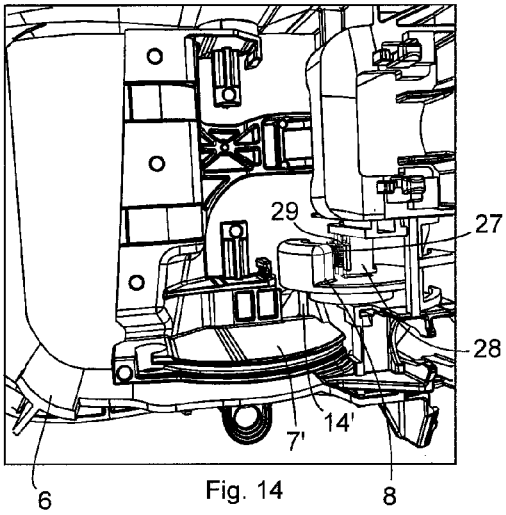
FIG. 14: a perspective view of a mechanical return element for the door handle assembly, in accordance with the second embodiment.

The coupling device 7' depicted in FIG. 13 has, as with the first embodiment form, a mass 9, a projecting pivot arm 10, and axle journals 11, for the rotatable support on the handle mounting 6, wherein corresponding receiving elements 12 are provided on the handle mounting 6 for the axle journals 11 (see FIG. 10, by way of example). With regard to the function of the mass 9, reference is made to the explanations referring to the first embodiment. As can further be derived from FIG. 13, the coupling device 7' has a movement projection 14' acting together with the locking device 8', wherein a movement cavity 15' is formed for this purpose on the locking device 8' (see FIG. 12), into which the movement projection 14' of the coupling device 7' can be moved for actuating the operating handle 4 when the locking device 8' is disposed in the normal operating position, as shall be explained in greater detail below.

Figure 11:
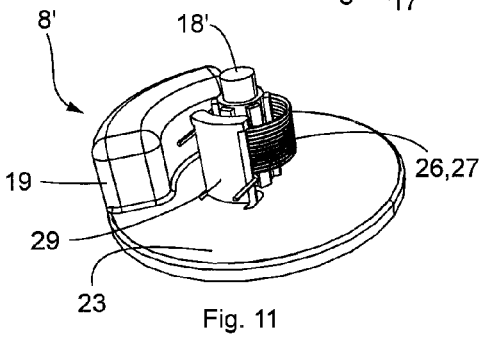
FIG. 11: a perspective view of a locking device for the door handle assembly, in accordance with the second embodiment.

With the second embodiment of the door handle assembly 3', the locking device 8' is designed in sections as a disk element 23, as is shown, for example, in FIGS. 11 and 12. The movement cavity 15' is formed on one of the two lateral surfaces of the disk element 23 as a guide channel 24, open on one side (see FIGS. 12 and 18, by way of example), for guiding the movement projection 14' when the locking device 8' is in its normal operating position. The guide channel 24 extends on the lateral surface of the disk element 23, offset to its center.

Figure 15:
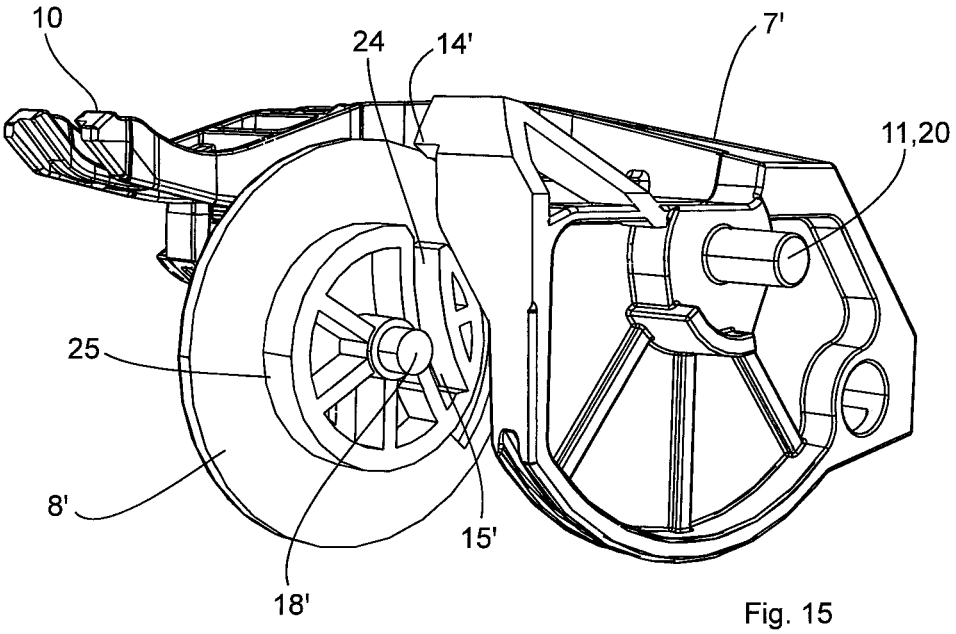
FIG. 15: a perspective view of the door handle assembly from FIG. 10, with the locking device in the normal operating position and an un-actuated operating handle.
Figure 16:
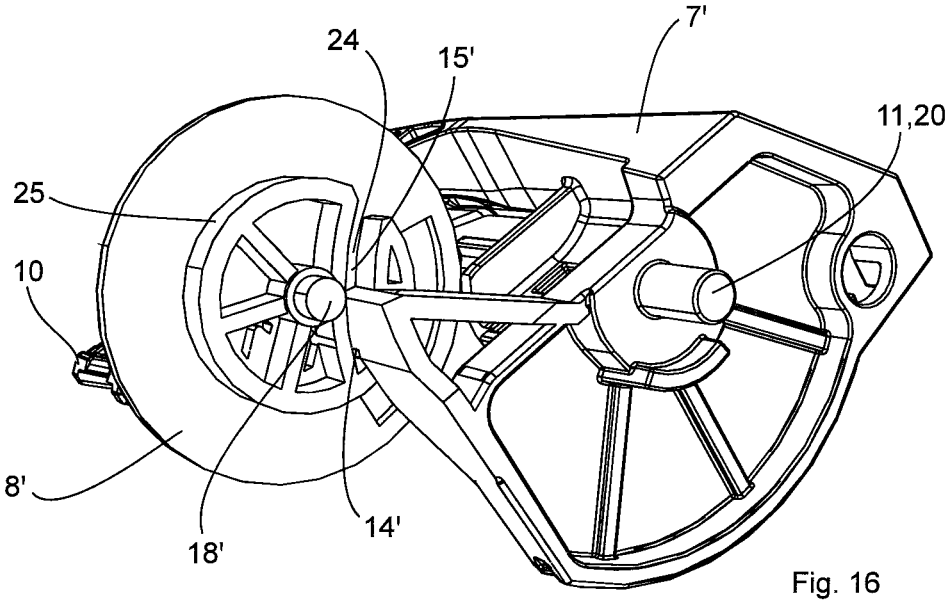
FIG. 16: a perspective view of the door handle assembly from FIG. 10, with the locking device in the normal operating position and an actuated operating handle.

FIGS. 10 and 15 each show a state of the door handle assembly 3', in which the locking device 8' is disposed in its normal operating position, and the coupling device 7' is in the rest position, due to the operating handle 4 not being actuated. The movement projection 14' of the locking device 8' is disposed in the normal operating position, outside of the guide channel 24 when the operating handle 4 is not actuated. In the state shown in FIGS. 10 and 15, the movement cavity 15', designed as a guide channel 24 that is open on one side, is disposed in the movement path of the movement projection 14', such that the movement projection 14' is moved toward the open side of the movement cavity 15', or the guide channel 24, respectively, when the operating handle 4 is actuated. In the state shown in FIG. 16, the operating handle 4 is completely actuated, such that the coupling device 7' is pivoted about its point of rotation 20, about the Z axis of the door handle assembly 3'. In this state of the coupling device 7', the movement projection 14' is also pivoted, such that this movement projection is now disposed within the guide channel 24. To the extent that no large acceleration forces act on the door handle assembly 3', and the operating handle 4 is actuated, the actuation projection 14' is moved into the guide channel 24. As soon as the user releases the operating handle 4, the coupling device 7' is pivoted back into the position shown in FIG. 15, as a result of the spring tension, which forces the coupling device 7' into the rest position, as a result of which, the movement projection 14' is again moved out of the guide channel 24.

Figure 17:
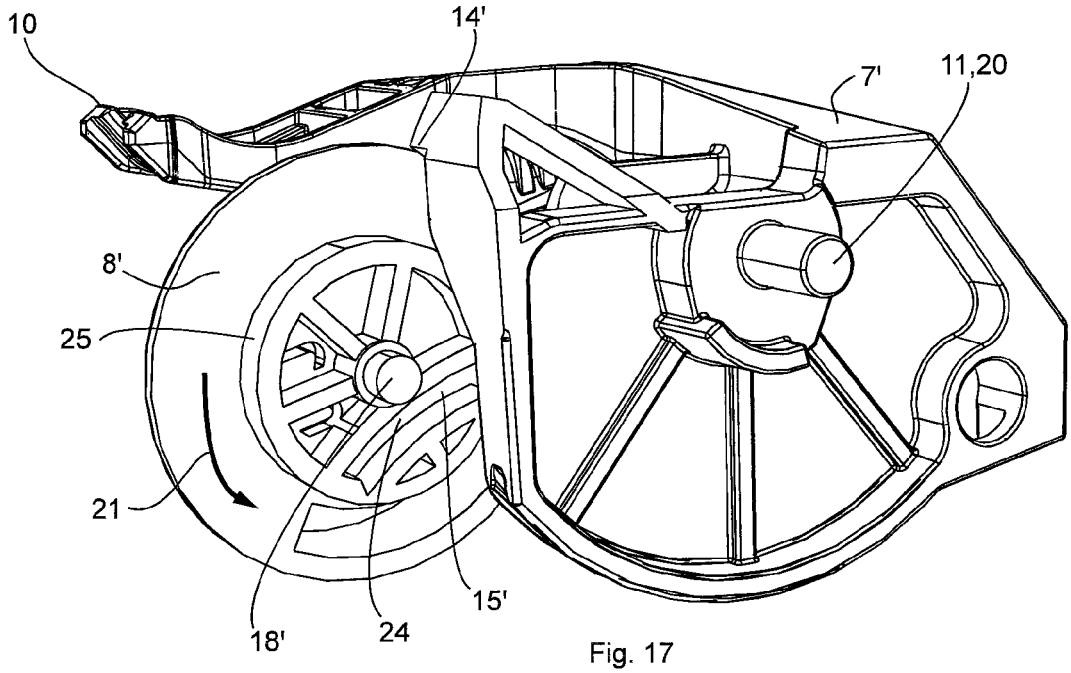
FIG. 17: a perspective view of the door handle assembly from FIG. 10, with the locking device after it has moved in a first blocking direction.
Figure 18:
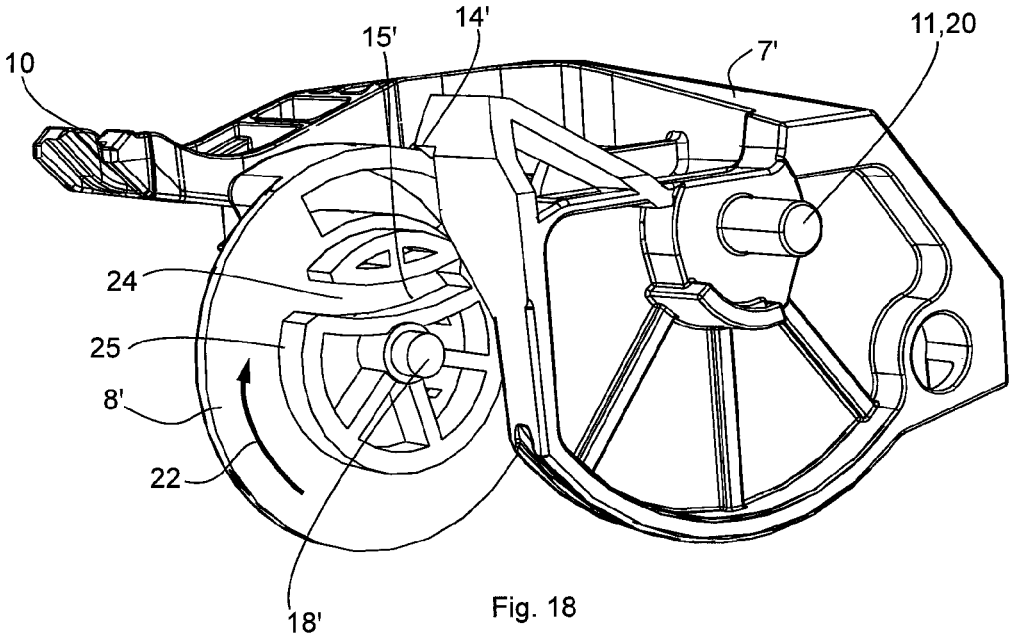
FIG. 18: a perspective view of the door handle assembly from FIG. 10, with the locking device after it has moved in a second blocking direction.

FIGS. 17 and 18 show the other states of the door handle assembly 3' according to the second embodiment, in which an acceleration force acts on the locking device 8', such that the locking device 8' is moved out of the normal operating position, and is then located in one of the respective blocking positions. The locking device 8' is rotatably supported on the handle mounting 6 by means of a pivot axle 18', such that it can rotate about the Z axis of the door handle assembly 3', and likewise has a mass weight 19, wherein the locking device 8' is rotatably supported at its center by means of the pivot axle 18'. In that the mass weight 19 is disposed offset to the pivot axle 18', the locking device 8' is moved out of its normal operating position by the effects of an acceleration force, wherein the movement in the first or second blocking direction 21, 22 is also a rotational movement about the pivot axle 18' in the second embodiment, and the locking device 8' swings about the pivot axle 18' during a vehicle accident, until it is deflected by the oscillations caused by the acceleration force. In FIG. 17, the locking device 8' is rotated −285° about the pivot axle 18' (Z axis) as the result of the effects of an acceleration force in the first blocking direction 21 (see arrow 21 in FIG. 17), such that the movement cavity 15', designed in the manner of a blind hole, i.e. the guide channel 24, is now no longer in the movement path of the movement projection 14'. In FIG. 18, in contrast, the locking device 8' is rotated +285° about the pivot axle (Z axis) as a result of the effects of an acceleration force, or as a result of a swinging movement, in the second blocking direction 22 (see arrow 22 in FIG. 18), by means of which the guide channel 24, or the movement cavity 15', respectively, is then no longer in the movement path of the movement projection 14'. An actuation of the operating handle 4 or a pivoting of the coupling device 7', which is rotatably supported on the handle mounting 6, such that it can rotate about its axle journals 11, is then blocked in FIGS. 17 and 8 as a result of the rotation of the locking device 8' about the pivot axle 18', because the movement projection 14' can no longer enter the guide channel 24, or move into this guide channel, respectively, due to the rotation of the coupling device 7'. Instead, the movement projection 14' hits a contact surface 25, having the shape of a segment of a circle, which is formed on the lateral surface of the disk-shaped locking device 8' lying opposite the mass 19. With the second embodiment of the door handle assembly 3', which FIGS. 10-18 relate to, the pivot axle 18' of the locking device 8' is oriented substantially parallel to the point of rotation 20 of the coupling device 7', in order to obtain the desired blocking of the operating handle 4, or the coupling device 7', when acted on by an acceleration force. Alternatively to rotating at the rotational angle of ±285° about the locking device 8' in FIGS. 17 and 18, from the normal operating position, as a result of the effects of an acceleration force in the first or second blocking direction 21, 22, a smaller rotational angle is also conceivable.

Both the first as well as the second embodiment of the door handle assembly 3, or 3', respectively, have at least one mechanical return element 26. The mechanical return element 26 (see FIGS. 3 and 11, by way of example) exerts a force that forces the locking device 8, 8' into the normal operating position, such that this does not presently concern a locking device that locks in position, but rather, it concerns a locking device that returns to its starting position. By way of example, the mechanical return element 26 can comprise an elastic spring element 27, as is depicted in the two embodiments. The respective spring element 27 is supported at both ends, on both a projection 28 of the handle mounting 6, that is fixed in place, as well as on a contact surface 29 that moves together with the locking element 8, 8' (see FIGS. 5 and 14). With a movement of the locking device 8, 8' in the first or second blocking direction 21, 22 as a result of the effects of an acceleration force, the contact surface 29 moves in relation to the projection 28 against the force of the elastic spring element 27, in that one of the two ends of the spring element 27 is deflected. In order that the locking device 8, 8' does not already rotate into a blocking position during smaller vibrations, the mechanical return element 26, or the spring element 27, respectively, is designed such that it retains the locking device 8, 8' in the normal operating position, until an acceleration force of at least 7 g has been applied.

In summary, with the present invention, a door handle assembly 3, 3' having a non-locking locking device 8, 8' is provided, which is distinguished by a secure activation, and which securely blocks the operating handle 4, or the coupling device 7, 7', respectively, even with oscillations resulting form the effects of acceleration forces. This is enabled according to the invention in that the locking device 8, 8' can rotate at least ±90° about its pivot axle 18, 18', such that swinging movements in both directions, i.e. rotational movements in opposite directions, by the locking device 8, 8' are possible. With the door handle assemblies known from the prior art, the path for the deflection of the locking device, in order to move it into the movement path of the coupling device, is too small, which leads to situations in practice, in which the locking device moves back, after its deflection, as a result of oscillations, in an abrupt manner, and the coupling device is not blocked at times, which leads to an undesired actuation of the closing assembly and opening of the door. This danger is no longer present with the present invention, because the locking device 8, 8' has a greater path to travel when activated, which is defined by the rotational movement as at least 90° about the pivot axle 18, 18'. Furthermore, the locking device 8, 8' can move in two opposing blocking directions, such that a blocking of the operating handle 4, or the coupling device 7, 7', respectively, is provided, even during a swinging of the locking device 8, 8' in both directions. According to a first embodiment, the pivot axle 18 of the locking device 8 is oriented substantially transverse to the point of rotation 20 of the coupling device 7, whereas, with the second embodiment, the pivot axle 18' of the locking device 8' is oriented substantially parallel to the point of rotation 20 of the coupling device 7'. This configuration guarantees an activation of the locking device 8, 8' with effective acceleration forces, which act laterally on the motor vehicle in the interior of the vehicle or in the opposite direction (±Y axis).

The invention described above is, as a matter of course, not limited to the embodiments described and depicted herein. It is evident that numerous modifications, obvious to the person skilled in the art with regard to the intended use, can be made to the embodiments depicted in the drawings, without abandoning the field of the invention thereby. All that is contained in the description and/or depicted in the drawings, including that which deviates from the concrete embodiment examples, which is obvious to the person skilled in the art, belongs to the invention thereby.

The invention claimed is:

1. A door handle assembly for a motor vehicle, comprising:

a handle mounting, an operating handle, which is moveably supported on the handle mounting for the opening of a door or hatch of the motor vehicle by a user, a mechanical coupling device, by means of which a movement of the operating handle can be transferred to a vehicle-side closing assembly, and a locking device serving as a mass locking device, which is moveably retained on the handle mounting and is designed such that it can be moved, with the effects of an acceleration force which is acting in a first direction, from a normal operating position, in which an actuation of the operating handle is possible, in a first blocking direction, in which an actuation of the closing assembly by the coupling device, is blocked, wherein the locking device, is designed such that it can move, with the effects of an acceleration force which is acting in a second direction, from a normal operating position, in a second blocking direction, in which an actuation of the closing assembly by the coupling device, is blocked, wherein the second blocking direction is opposite the first blocking direction, wherein the coupling device includes at least one movement projection that acts together with the locking device, and wherein the locking device includes a movement cavity, into which the movement projection of the coupling device can at least be moved, for actuating the operating handle, when the locking device is disposed in the normal operating position.

2. The door handle assembly according to claim 1, wherein the locking device is designed at least in part as a hollow cylinder, wherein the movement cavity is formed such that it runs in the longitudinal direction of the hollow cylinder, starting at the open front end thereof.

3. The door handle assembly according to claim 2, wherein, in the normal operating position of the locking device, the movement projection extends into the open front end of the hollow cylinder, when the operating handle is not actuated, and when the operating handle is actuated, the actuating projection is designed such that it passes through the movement cavity and out of the hollow cylinder, moving away from the locking device.

4. The door handle assembly according to claim 1, wherein the locking device is designed, at least in part, as a disk element, on one lateral surface of which the movement cavity of the locking device is designed as a guide channel that is open on one side, which extends, offset to the center of the disk element, on the lateral surface thereof.

5. The door handle assembly according to claim 4, wherein in the normal operating position of the locking device, the movement projection is disposed outside of the guide channel when the operating handle is not actuated, and when the operating handle is actuated, the actuating projection is designed such that is moves into the guide channel.

6. The door handle assembly according to claim 1, wherein the locking device is rotatably supported on the handle mounting by means of a pivot axle, and in that the movement of the locking device in the first or second blocking direction is a rotational movement.

7. The door handle assembly according to claim 6, wherein the pivot axle of the locking device is rotatably supported at its midpoint.

8. The door handle assembly according to claim 6, wherein the locking device, with the effects of an acceleration force, can be rotated at least ±90°, about the pivot axle, out of the normal operating position.

9. The door handle assembly according to claim 6, wherein the locking device has a mass weight, which is disposed on the locking device, offset to the pivot axle.

10. The door handle assembly according to claim 6, wherein the coupling device is rotatably supported on the handle mounting such that it can rotate about a point of rotation, wherein the pivot axle of the locking device is oriented substantially transverse to the point of rotation of the coupling device.

11. The door handle assembly according to claim 6, wherein the coupling device is rotatably supported on the handle mounting such that it can rotate about a point of rotation, wherein the pivot axle of the locking device is oriented substantially parallel to the point of rotation of the coupling device.

12. A door handle assembly for a motor vehicle, comprising:

a handle mounting, an operating handle, which is moveably supported on the handle mounting for the opening of a door or hatch of the motor vehicle by a user, a mechanical coupling device, by means of which a movement of the operating handle can be transferred to a vehicle-side closing assembly, and a locking device serving as a mass locking device, which is moveably retained on the handle mounting and is designed such that it can be moved, with the effects of an acceleration force which is acting in a first direction, from a normal operating position, in which an actuation of the operating handle is possible, in a first blocking direction, in which an actuation of the closing assembly by means of the coupling device, is blocked, wherein the locking device is designed such that it can move, with the effects of an acceleration force which is acting in a second direction, from a normal operating position, in a second blocking direction, in which an actuation of the closing assembly by the coupling device, is blocked, wherein the second blocking direction is opposite the first blocking direction, wherein a mechanical return element is provided, which exerts a force that forces the locking device into the normal operating position, and wherein the mechanical return element comprises an elastic spring element, which is supported on both a projection of the handle mounting, which is fixed in position, as well as on a contact surface that moves together with the locking element, wherein, with the movement of the locking device in the first or second blocking direction, the contact surface moves in relation to the projection against the force of the elastic spring element.

13. The door handle assembly according to claim 12, wherein the mechanical return element is configured such that it retains the locking device in the normal operating position, until an acceleration force of at least 7 g has been applied.

* * * * *